US005635689A

United States Patent [19]

Shepard et al.

[11] Patent Number: 5,635,689

[45] Date of Patent: Jun. 3, 1997

[54] ACCELERATION DAMPING OF ELEVATOR RESONANT MODES AND HYDRAULIC ELEVATOR PUMP LEAKAGE COMPENSATION

[75] Inventors: Mark E. Shepard, Bristol; Richard N. Fargo, Plainville; Harold Terry, Avon, all of Conn.

[73] Assignee: Otis Elevator Company, Farmington, Conn.

[21] Appl. No.: 389,859

[22] Filed: Feb. 17, 1995

[51] Int. Cl.[6] ..... B66B 1/34

[52] U.S. Cl. ..... 187/292; 187/285

[58] Field of Search ..... 187/285, 286, 187/292, 293

[56] References Cited

U.S. PATENT DOCUMENTS

| | | | |
|---|---|---|---|
| 3,638,093 | 1/1972 | Ross | 318/687 |
| 4,269,286 | 5/1981 | Ishii et al. | 187/29 R |
| 4,271,931 | 6/1981 | Watanabe | 187/29 R |
| 4,520,906 | 6/1985 | Watanabe | 187/29 R |
| 5,027,925 | 7/1991 | Kahkipuro | 187/115 |
| 5,086,882 | 2/1992 | Sugahara et al. | 187/95 |
| 5,243,154 | 9/1993 | Tomisawa et al. | 187/111 |
| 5,490,577 | 2/1996 | Yoo | 187/252 |
| 5,542,501 | 8/1996 | Ikejima et al. | 187/292 |

FOREIGN PATENT DOCUMENTS

| | | | |
|---|---|---|---|
| 60-15374 | 1/1985 | Japan . | |
| 61-22675 | 6/1986 | Japan | B66B 7/08 |
| 1-156293 | 6/1989 | Japan | B66B 11/02 |
| 1-197294 | 8/1989 | Japan | B66B 7/04 |
| 6-329368 | 11/1994 | Japan | B66B 9/02 |
| 2271865 | 4/1994 | United Kingdom | G05B 13/04 |

*Primary Examiner*—Robert Nappi

[57] ABSTRACT

A speed command signal is applied to a variable voltage, variable frequency controller for driving a three-phase induction motor that operates a positive displacement pump for supplying fluid to a hydraulic elevator drive cylinder. An accelerometer mounted on the car provides an acceleration-related feedback signal to the car speed command input of the motor control, thereby to dampen low frequency resonant modes of the elevator car. A sensor on a check valve between the hydraulic pump and the hydraulic cylinder provides a signal indicative of when the pump pressure is sufficient to support the car load, and the check valve begins to open; the signal is used to memorize ramped-up motor speed at that point, which equals the motor speed necessary to overcome pump leakage in order to support the car. That speed is added into the car speed command at the input of the motor controller to compensate for pump leakage. The acceleration damping of low frequency resonant modes of the elevator car may be utilized in roped elevator systems.

13 Claims, 2 Drawing Sheets

ACCELERATION DAMPING OF ELEVATOR RESONANT MODES AND HYDRAULIC ELEVATOR PUMP LEAKAGE COMPENSATION

TECHNICAL FIELD

This invention relates to using an accelerometer mounted on an elevator car to derive vertical acceleration for use in an elevator car speed control algorithm, and to compensation of car speed errors in hydraulic elevators due to pump leakage.

BACKGROUND ART

It is desirable to operate elevators in a manner to provide the quickest floor-to-floor travel time consistent with acceptable levels of acceleration and jerk, as well as providing a suitably smooth ride. In traditional hydraulic elevators, a positive displacement pump is driven by a constant speed motor, and acceleration/deceleration of the car is controlled by valving of the hydraulic fluid. The acceleration and deceleration of the car varies with the load in the car and with temperature-dependent viscosity of the hydraulic fluid. Therefore, precise car speed profile control is impossible, and a time-wasting, slow creep speed is needed near each landing to ensure that the car will not overshoot the landing and that it can be brought to a controlled stop. The overall speed of these elevators is quite low compared to traction (rope driven) elevators, and the energy consumption is several times greater than that of traction elevators.

In the past few years, hydraulic elevators which emulate characteristics of conventional traction elevators have been attempted, utilizing variable speed hydraulic pumps driven by induction motors, controlled by variable voltage, variable frequency (VVVF) inverters utilizing car speed control algorithms responsive to car reference speed profile generators. Regulating the flow of hydraulic oil to control car speed allows much closer control over car acceleration and speed, and utilizes energy much more efficiently.

However, accurate control over car speed is hampered by temperature-responsive variations in volume and viscosity of hydraulic oil, and attendant variations in speed inaccuracies resulting from pump leakage. Furthermore, due to the inherent low rigidity (flexibility) of the related hydromechanical system (particularly where an offset hydraulic cylinder is utilized with a lifting rope), the car is subjected to low frequency resonant modes which increase peak values of required jerk and acceleration, and result in an uncomfortable, bumpy ride.

Prior attempts to reduce car vibration have utilized the integral of the difference between pump angular speed and car speed as a feedback input to the car speed controller. Attempts to compensate for car speed variations as a function of pump leakage have included correcting the commanded (or reference) car speed from the car speed profile generator by the integral of the difference between commanded car speed and actual car speed.

Heretofore, the use of closed loop elevator car controls has not proved adequate to the task due to low accuracy of the car speed control and instabilities in car speed induced by the controller.

DISCLOSURE OF INVENTION

Objects of the invention include improved elevator car motion in a speed-controlled, elevator motion control system; mitigating low frequency oscillations in speed-controlled hydraulic elevator systems; and mitigation of car speed errors due to pump leakage in speed-controlled hydraulic elevator systems.

According to the present invention, the motion of an elevator is controlled, in response to a reference car speed profile generator, by a car speed controller which combines car vertical acceleration, derived directly from an accelerometer mounted on the car, with the car speed error signal from which the command is derived. In one embodiment of the invention, the car speed command error combined with actual car acceleration is used in a closed loop motor speed control which in turn controls the flow of fluid provided to a car hoist cylinder.

In accordance further with the invention, the motor speed command required to support the present elevator load under current pump leakage conditions is added to the car speed command to compensate for pump leakage.

The present invention provides smooth elevator motion and permits hydraulic elevators to provide fast, smooth, reliable motion. The invention is readily implemented utilizing only technology available in the art, in the light of the teachings which follow hereinafter.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
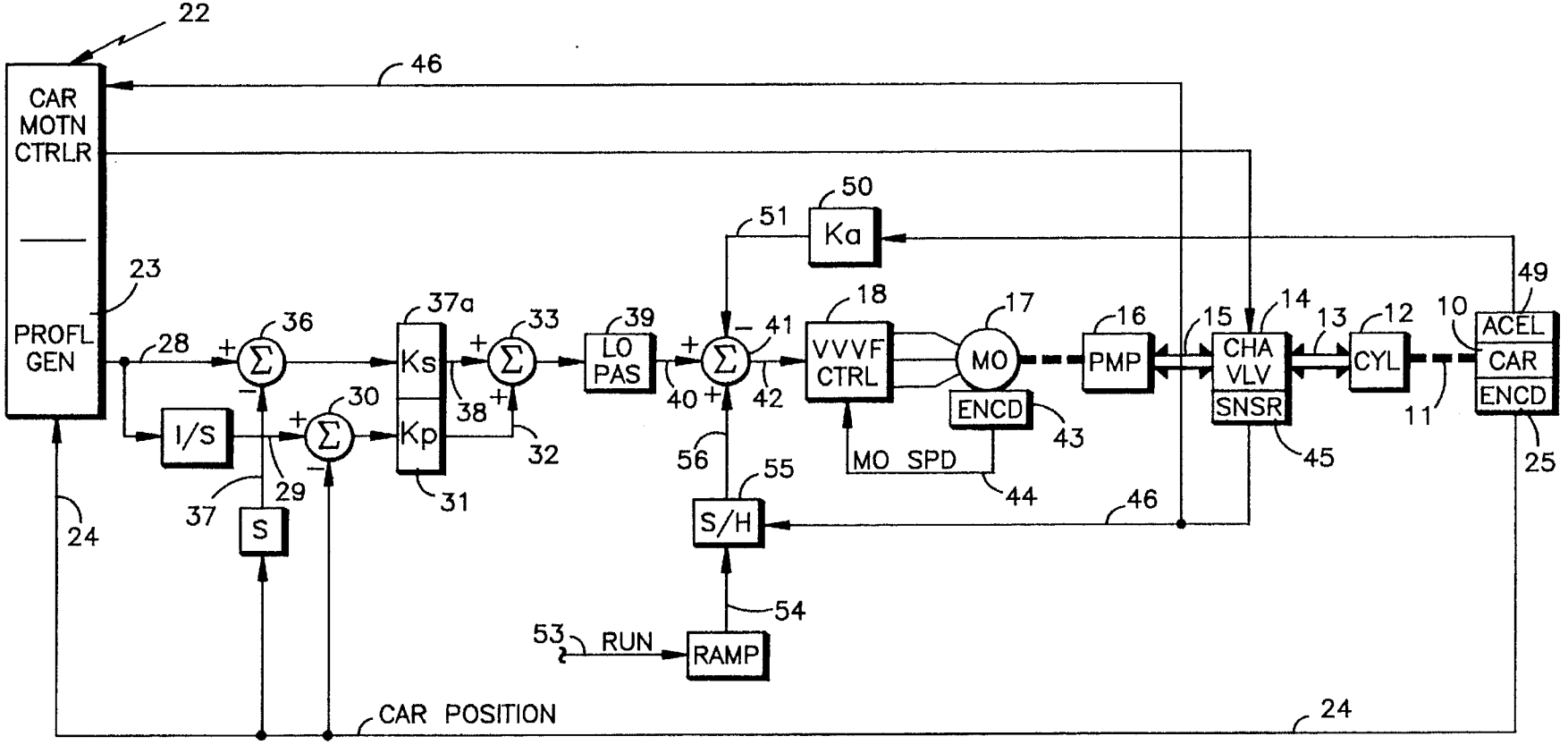
FIG. 1 is a functional diagram of the present invention.

Referring now to the drawing, an elevator car 10 is connected, either directly or by means of roping 11, to an hydraulic hoist cylinder 12, to which fluid under pressure is provided via conduits 13, a check valve 14 and conduits 15, from a positive displacement pump 16 which is driven by an electric motor 17. In this embodiment, the motor 17 is a three phase induction motor which is driven by a motor speed control 18, such as a variable voltage, variable frequency (VVVF) motor speed control.

A car motion controller 22 includes a car speed profile generator 23 which, in this embodiment, generates car speed commands as a function of time during the principal portion of the elevator run, and after the elapse of a predetermined period of time, responds to position signals 24 provided by a car encoder 25 mounted on the car 10 and operated by a stationary tape within the hoistway (not shown). Depending upon the remaining distance at this time, the profile generator will dictate car speed to bring the car to the next landing stop in a controlled manner, all as is known and not relevant to the present invention. The profile generator 23 provides a car reference speed signal 28 which is integrated to provide a position command signal 29 to a summing function 30 where the position signals 24 are subtracted therefrom. The output of the summing function is scaled by a position constant 31, Kp, to provide a position command portion signal 32 to a summing function 33. The car reference speed signal 28 is also provided to a summing function 36 in which an actual car speed signal 37, derived from the actual 5 position signals 24, is subtracted therefrom. The output of the summing function 36 is scaled by a speed gain 37, Ks, to provide a speed command portion signal 38 for application to the summing function 33. The summation is low pass filtered at 39 to provide a car speed error signal 40 as an input to a summing function 41, the output of which is a motor speed command signal 42 which is applied to the VVVF control 18. As is common, the motor 17 has an encoder 43 integrally disposed thereon to provide a motor speed signal 44 which is fed back to the VVVF control 18 in the usual fashion. The check valve 14 may preferably be of the type described in U.S. Pat. No. 5,212,951 which includes a sensor 45 that senses when the check valve just begins to open, and provides a check valve opening signal on a line 46 that is used in the motion controller 22 in a manner described therein. Of course, some elements of the hydraulic system are not shown herein. For instance, the motor 17 and pump 16 are typically disposed in an hydraulic fluid reservoir.

The system described thus far will provide rapid and well-controlled movement of the car from floor to floor. However, the actual car speed varies from commanded car speed as a result of pump leakage, which in turn varies as a function of hydraulic oil temperature and viscosity, and load in the car. Additionally, due to elasticities in the drive system, the instantaneous car speed is quite erratic, giving rise to a bumpy ride. According to the invention, this latter problem is mitigated by mounting an accelerometer 49 directly on the car 10, and using the acceleration signal scaled by a gain 50 (Ka) as a negative feedback into the summing function 41 in the generation of the motor speed command signal 42. Thus, low frequency resonant modes of car motion are substantially cancelled by the signal on the line 51.

The leakage problem is solved in accordance with the invention by using, as speed compensation, the actual motor speed command at the precise time that the motor speed command causes the motor to drive the pump sufficiently to satisfy all of the pump leakage and allow the hydraulic pressure in the system to build up to match the load of the car. This leakage remains essentially constant with greater flow, as the car is placed in motion. When the car motion controller determines that it is time for the car to make a run to the next floor stop, it provides to the motor control a prepare to run signal which causes energizing and initialization of the motor control circuitry, and then sends a run signal (equivalent to a lift brake signal in a traction elevator) which causes the motor to actually start to run. In the embodiment illustrated in FIG. 1, a run signal 53 will cause a pump leakage speed command signal 54 to begin ramping up; this is illustrated as passing through a sample and hold function 55 to a signal input 56 to the summing function 41. This causes a ramp up motor speed command signal 42 to be applied to the motor control 18, causing the motor to ramp up its speed. During this time, no car speed error is being generated, which function begins only after the check valve sensor indicates by the signal on the line 46 to the motion controller 22, that the load is being supported by fluidic pressure in the cylinder. When the sensor 45 provides the check valve opening signal on line 46, the sample and hold function 55 records (memorizes) the motor speed command instantaneously indicated on the line 54, and applies this recorded motor speed command to the summing function 41 over the line 56.

In the preferred embodiment, most of the signal processing within and external of the VVVF control 18 is performed through digital processing in a computer, in a well-known fashion. An embodiment of the invention employing digital processing is illustrated in a simplistic fashion by the logic flow diagram of FIG. 2. Therein, a speed command routine is entered periodically, such as every 1.6 milliseconds, through an entry point 60. A first test 61 determines if elevator motion control is appropriate or not by testing whether the door is fully closed. If it is not, a negative result of test 61 causes the computer to revert to other programming through a transfer point 62. After the doors are fully closed, the routine of FIG. 2 reaches a test 63 to see if the car has been commanded to run, or not, as indicated by a run command signal (equivalent to a "lift brake" command in a traction elevator). If it has not, then to initialize conditions for a run, a negative result of test 63 reaches a step 64 to reset an encoder counter (a counter which continuously responds to pulses transmitted to it from the encoder 25 disposed on the car 10). A step 65 resets a locally used check valve flag, which keeps track of the first pass through the routine of FIG. 2 after the sensor 45 indicates that the check valve 14 is beginning to open. A step 66 resets a leakage speed counter, which is used to ramp up the motor speed and provide pump leakage speed compensation. And then, the computer reverts to other programming through the return point 62.

Figure 2:
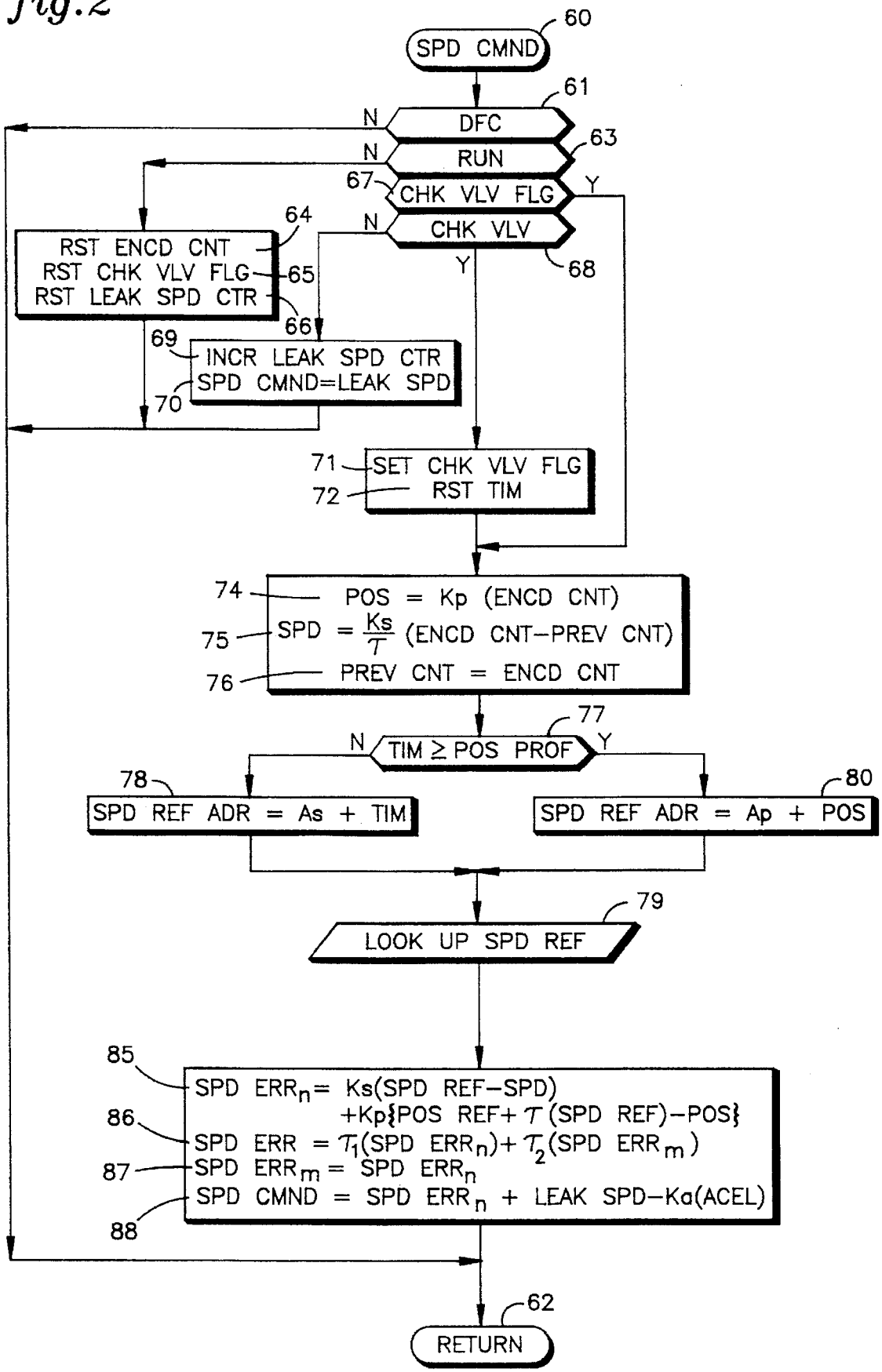
FIG. 2 is a simplified logic flow diagram of a digital embodiment of the invention.

Eventually, the car will be commanded to run, so a pass through the routine of FIG. 2 will have affirmative results of both tests 61 and 63 and thereby reach a test 67 to see if the check valve flag has been set yet, or not. Initially, it will not have been set, so a negative result of test 67 will reach a test 68 to see if the sensor 45 is providing the check valve opening signal, indicating that the check valve is opening, or not. In the initial passes through the routine, the pressure will not yet be equalized sufficiently to support the car, so a negative result of test 68 will reach a step 69 which increments the leakage speed counter so that a step 70 will provide a speed command to the motor control 18 that it will cause the motor speed to begin ramping up. And, then, other programming is reverted to through the return point 62. The pump speed should not be ramped up too quickly since it may overshoot once the check valve begins to open; it may take on the order of one-half second or one second to ramp up the pump speed. The increment used in the step 69 can be chosen with respect to the cycle time of the speed command routine of FIG. 2 so as to cause ramping up in a desired fashion, by successive passes through a negative result of test 68, and the steps 69 and 70 which continuously present an increasing speed command to the motor control.

After one-half second or so, the pressure across the check valve 14 will be balanced and the sensor 45 will provide a signal indicating that the check valve is opening so that a pass through the routine of FIG. 2 will reach an affirmative result of test 68, so that the leakage speed counter is no longer incremented in step 69, and reaches a step 71 which sets the check valve flag so that the leakage speed will not be changed again (until near the start of the next run) and a full speed profile command will be generated (as described below). And a step 72 resets a run timer (TIM), for use in the profile generator.

In subsequent passes through the routine of FIG. 2, the test 67 will be affirmative bypassing the test 68 and the steps 71, 72.

Following an affirmative result of test 66, or following step 70, a step 74 generates a position value (POS) as equal to some constant, kp, related to counts per revolution of the car encoder 25 and revolutions per length of its associated tape, times the count in the encoder counter. Then a step 75 generates a value of car speed (SPD) as equal to a speed constant, ks, which either includes or is divided by a time value related to the cycle time of the computer, T, times the difference between the present car encoder count and the car encoder count at the previous cycle, and then the encoder count (to be used in the next cycle as the previous count) is updated in a step 76. A test 77 determines if the elapsed time in this run (since being reset in the step 70) equals or exceeds the time at which the position profile is to begin. During the early parts of a run, a negative result of test 77 reaches a step 78 where a car speed reference address, related to a timed car speed profile, is set equal to a base address related to time, $A_r$, plus the current time. This address is used in a subroutine 79 to look up a car speed reference for use in this cycle of speed command generation. Near the end of the run, the time will equal, and then exceed, the time when a position profile is to be utilized, so an affirmative result of the test 77 will reach a step 80 to cause the speed reference address to be set equal to a base address related to a position car speed profile, $A_p$, plus the car position value generated in step 74. And, the car speed reference is looked up by the subroutine 79.

A step 85 generates a car speed error for cycle n which is equivalent to the output of the summing function 33. This is therefore the sum of two terms, the first of which is the speed constant, Ks, times the difference between the car speed reference provided by the profile generator and the actual speed of the car generated in step 75. The second term is the constant Kp times the difference between the present position of the car (as generated in step 74), and the integral of the car speed reference, which is generated as a summation of an accumulated value, POS REF, and some time constant, $\tau$, times the speed reference provided by the profile. The speed error for cycle n is then integrated in a step 86 as the summation of some fraction, $\tau_1$, of the speed error generated in this cycle (SPD $ERR_n$) with some fraction, $\tau_2$, of the speed error generated in the next prior cycle (SPD $ERR_m$). Then, the speed error for use in filtering in the following cycle, SPD $ERR_m$, is updated in a step 87. The generation of the motor speed command, equivalent to the summation function 41, is provided in a step 88, which adds the car speed error for this cycle (generated in step 86) to the leakage motor speed (reached in the last performance of step 69) and subtracts therefrom a function of the car acceleration determined by the constant Ka.

The use of an accelerometer mounted on the car to dampen low frequency resonant car modes has been described with respect to an hydraulic elevator embodiment of the invention. However, the invention may also be used to dampen low frequency resonant modes in roped elevators. In other words, instead of the pump 16, if the motor 17 were connected directly or through gearing to a sheave, for driving elevator roping, all of that portion of FIG. 1 to the left of the motor 17, with the exception of leakage speed, would be equally applicable, in which case steps and tests 65–69 may be eliminated, and the leakage speed term may be dropped in step 88. However, since the motor has a direct relationship of revolutions to car motion, the position feedback provided by the elements 29–32 of FIG. 1 would be optional, and the use thereof could be eliminated, if desired.

The present embodiment has been disclosed as employing a profile generator which is open ended at first, generating a speed reference profile as a function of time only. However, the invention can obviously be utilized in an embodiment which utilizes a position-dependent profile throughout each run, in which case steps 70 and 78 and test 77 may be eliminated in FIG. 2. The encoder 25 may be mounted in a machine room adjacent the motor 143 and driven by a traveling tape, as is known in the art. The encoder 25 may also include several phase-related tracks so as to directly decode position as well as speed, the position being useful in dispatching, all as is known in the art. A DC motor may be used instead of an induction motor, if desired. None of this is important to use of the present invention.

Using the speed command generated in step 69 as the pump leakage compensation speed in step 88 provides complete closed loop correction for pump leakage. Regardless of what actual speed the motor may have achieved at the point where all pump leakage is compensated, it does so in response to the command generated by the last iteration of step 69. Using this value in step 88 therefore totally compensates for it, with the exception of some slight variations which obtain at different speeds and perhaps changing temperature during the floor-to-floor run of the car.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system, comprising:

an elevator car disposed in a hoistway to serve a plurality of floors in a building;

a car speed sensor providing a car speed signal indicative of the speed of said car;

an electric motor;

an hydraulic hoist cylinder connected to said elevator car for vertically positioning said car in said hoistway;

a rotary pump connected to said motor for providing hydraulic fluid to said cylinder;

a motor speed sensor disposed on said motor to provide a motor speed signal indicative of the rotary speed of said motor;

a controller for providing a car reference speed signal and responsive to said car speed sensor to provide a car speed error signal indicative of the difference between the speed indicated by said car reference speed signal and the actual speed of said car indicated by said car speed signal and for providing a motor speed command signal in response to said car speed error signal; and a motor speed control responsive to said motor speed sensor and to said controller for causing said motor to operate at a rotary speed determined by said motor speed command signal;

characterized by the improvement comprising:

an accelerometer disposed on said car for providing an acceleration signal indicative of the vertical acceleration of said car; and wherein said controller is also responsive to said accelerometer to provide said motor speed command signal in response to a combination of said car speed error signal and said acceleration signal.

2. A system according to claim 1 wherein said means disposed between said motor and said car comprises:

a check valve disposed between said pump and said cylinder, said check valve preventing reverse flow of hydraulic fluid from said cylinder when said cylinder is holding said car stationary at a floor landing, said check valve having a sensor for providing a check valve signal indicative of said check valve beginning to open after pressure of fluid provided by said pump is equal to the pressure of fluid on the cylinder side of said check valve; and wherein said controller, when said car is to run, providing a continuously increasing pump leakage speed command signal until said check valve signal indicates that said check valve has begun to open, and thereafter providing a constant pump leakage speed command signal equal to the value thereof when said check valve began to open, said controller being also responsive to said pump leakage speed command signal to provide said motor speed command signal in response to the combination of said car speed error signal, said pump leakage speed command signal, and said acceleration signal, whereby to compensate for leakage in said pump.

3. A system according to claim 2 wherein said controller provides said motor speed command signal as the summation of said car speed error signal and said pump leakage speed command signal, minus said acceleration signal.

4. A system according to claim 1 wherein said electric motor is an induction motor.

5. A system according to claim 4 wherein said motor speed control is a variable voltage, variable frequency control.

6. A system according to claim 1 wherein said controller provides said motor speed command signal in response to the difference between said car speed error signal and said acceleration signal.

7. An hydraulic elevator system, comprising:

an elevator car disposed in a hoistway to serve a plurality of floors in a building;

an hydraulic hoist cylinder connected to said elevator car for vertically positioning said car in said hoistway;

a positive displacement rotary pump for providing hydraulic fluid to said cylinder;

a check valve disposed between said pump and said cylinder, said check valve preventing reverse flow of hydraulic fluid from said cylinder when said cylinder is holding said car stationary at a floor landing, said check valve having a sensor for providing a check valve signal indicative of said check valve beginning to open after pressure of fluid provided by said pump is equal to the pressure of fluid on the cylinder side of said check valve;

an electric motor for driving said pump;

a motor speed sensor disposed on said motor to provide a motor speed signal indicative of the rotary speed of said motor;

a controller responsive to said check valve signal for providing a motor speed command signal to effect a car speed profile after said check valve signal indicates said check valve is opening; and a motor speed control responsive to said motor speed sensor and to said controller for causing said motor to operate at a rotary speed determined by said motor speed command signal;

characterized by the improvement comprising:

said controller, when said car is to run, providing a continuously increasing pump leakage speed command signal until said check valve signal indicates that said check valve has begun to open, and thereafter providing a constant pump leakage speed command signal equal to the value thereof when said check valve began to open, said controller being also responsive to said pump leakage speed command signal to provide said motor speed command signal in response thereto, whereby to ramp up said motor speed to the point where the check valve opens and thereafter to compensate for leakage in said pump.

8. A system according to claim 7 wherein said electric motor is an induction motor.

9. A system according to claim 8 wherein said motor speed control is a variable voltage, variable frequency control.

10. A system according to claim 7 further comprising:

a car speed sensor providing a car speed signal indicative of the speed of said car; and wherein said controller provides a car reference speed signal and is responsive to said car speed sensor to provide a car speed error signal indicative of the difference between the speed indicated by said car reference speed signal and the actual speed of said car indicated by said car speed signal, and provides said motor speed command signal in response to a combination of said car speed error signal and said pump leakage speed command signal.

11. A system according to claim 10 wherein said controller provides said motor speed command signal in response to the summation of said car speed error signal and said pump leakage speed command signal.

12. A system according to claim 10 additionally comprising:

an accelerometer disposed on said car for providing an acceleration signal indicative of the vertical acceleration of said car; and wherein said controller is also responsive to said accelerometer to provide said motor speed command signal in response to a combination of said car speed error signal, said pump leakage speed command signal, and said acceleration signal.

13. A system according to claim 12 wherein said controller provides said motor speed command signal in response to the summation of said car speed error signal and said pump leakage speed command signal, minus said acceleration signal.

* * * * *